United States Patent [19]

Cahuzac

[11] Patent Number: 4,805,421

[45] Date of Patent: Feb. 21, 1989

[54] METHOD FOR KNITTING COMPOSITE REINFORCEMENTS

[75] Inventor: Georges J. J. Cahuzac, Saint Jean D'Illac, France

[73] Assignee: Aerospatiale Societe Nationale Industrielle, France

[21] Appl. No.: 157,459

[22] Filed: Feb. 17, 1988

[30] Foreign Application Priority Data

Feb. 17, 1987 [FR] France ..... 87 02013

[51] Int. Cl.[4] ..... D04B 9/12

[52] U.S. Cl. ..... 66/13; 139/387 R

[58] Field of Search ..... 66/10–13; 139/11, 72, 14, 387 R

[56] References Cited

U.S. PATENT DOCUMENTS

| | | | |
|---|---|---|---|
| 4,183,232 | 1/1980 | Banos et al. | 66/11 |
| 4,346,741 | 8/1982 | Banos et al. | 139/387 R |
| 4,393,669 | 7/1983 | Cahuzac | 66/13 |
| 4,492,096 | 1/1985 | Cahuzac | 66/11 |

*Primary Examiner*—Ronald Feldbaum

*Attorney, Agent, or Firm*—McGlew and Tuttle

[57] ABSTRACT

In this machine, rows of rods representing the woof threads are circulated in passages A, B, C defined between filaments forming concentric open loops having adjustable diameters. Disposed in the openings of the loops are needles (90) movable between neutral or open positions for deviating the rods from a passage into an adjacent passage in accordance with a predetermined sequence while depositing warp threads in circular layers between the rods. The rods are then replaced by woof threads by a lacing device.

1 Claim, 12 Drawing Sheets

METHOD FOR KNITTING COMPOSITE REINFORCEMENTS

The present invention generally relates to the manufacture of composite reinforcements of threads or fibers impregnated with resin and woven in more than two dimensions and it more particularly concerns a novel method for weaving such reinforcements.

Composite reinforcements woven in three dimensions are well known and widely used and the same is true of many methods for weaving such reinforcement elements.

The applicant has invented a reinforcement having a novel texture described and claimed in the French patent application No. 87/02012 filed Feb. 17, 1987 for "Woven Reinforcement for a Composite Material".

This reinforcement, formed by woof threads and warp threads, has a texture formed by a basic pattern constituted by fifteen woof threads R in a staggered arrangement, forming six columns 1 to 6 of alternately two and three threads and at least five lines 1 to 5 perpendicular to said columns and each having three threads, and by six imbricated layers C1 to C6 of at least two parallel warp threads, namely at least twelve threads a, b, c, . . . 1, each connecting every third woof thread of the same column in two adjacent lines and the warp threads of consecutive layers connecting woof threads in alternating columns, the first thread a of the first layer C1 connecting the woof thread R of column 2 in line 1, namely $R_1^2$ to the woof thread R of column 5 in line 2, namely $R_2^5$; the second thread b of the first layer C1 connecting the woof thread R of column 2 in line 3, namely $R_3^2$, to the woof thread R of column 5 in line 4, namely $R_4^5$; the first thread c of the second layer C2 connecting the woof thread R of column 1 in line 2, namely $R_2^2$, to the woof thread R of column 4, in line 1, namely $R_1^4$; the second thread d of the second layer C2 likewise connecting the woof threads $R_4^1$ and $R_3^4$ the paths of the threads of the following layers C3, . . . C6 being obtained by adding 2 to each preceding corresponding column reference, namely, for the first thread of layer $C3=R_2^{1+2}=R_2^3$ and $R_1^{4+2}$ $R_1^6$, etc., said pattern being capable of being enlarged in the direction of the thickness of the material to be produced, with an uneven number of lines.

U.S. Pat. Nos. 4,183,232 and 4,346,741 which are incorporated herein as reference disclose a machine for weaving in three dimensions a composite reinforcement element comprising a frame formed by a base carrying a plurality of vertical guide columns on which horizontal frames are slidably mounted and engaged with rotary lead-screws for raising or lowering these frames.

Plates are rotatively mounted on these frames and are perforated in a plurality of circular and radial rows with orifices in which are disposed corresponding rows of vertical metal rods which also extend through corresponding rows of orifices formed in at least two horizontal disks located between said frames and suspended from the upper frame by chains.

Fixed in the upper part of the machine is a knitting device comprising, among other elements, an annular member having radial notches in which are slidable bars adapted to be raisable, and a pressure plate including a coating having a low coefficient of friction, and a device for recycling said bars.

This known machine is completed by a lacing device of known type for replacing the metal support rods of the knitted element by threads, such as disclosed in U.S. Pat. No. 4,393,669, also incorporated herein.

An object of the present invention is to provide a new method for weaving such a reinforcement by means of a machine of the type cited above. According to the invention, the method for weaving composite reinforcement of the aforementioned type comprise rotating flexible rods arranged in circular rows of N radially aligned rods representing the woof threads R so that their upper ends circulate in concentric circular passages formed by filaments each having radially aligned switching means, depositing layers of woof threads C1 to C6 under and in alignment with the filaments, bending and deviating said ends to the rods by the action of said switching means by shifting the latter between a neutral position 0, a position 1 oriented toward the interior and a position 2 oriented toward the exterior according to the following sequence for six complete revolutions, namely for the basic pattern:

For the layer C1 : 1, 1, 0, 0, 0, 1×N/6
For the layer C2 : 0, 2, 2, 0, 1, 1×N/6
For the layer C3 : 2, 0, 1, 1, 0, 2×N/6
For the layer C4 : 0, 2, 2, 2, 0, 2×N/6
For the layer C5 : 1, 1, 0, 2, 2, 0×N/6
For the layer C6 : 2, 0, 1, 1, 0, 2×N/6, and replacing said rods by the woof threads R.

The following description with reference to the accompanying drawings given by way of non-limitative examples will explain how the invention may be carried out.

Figure 2:
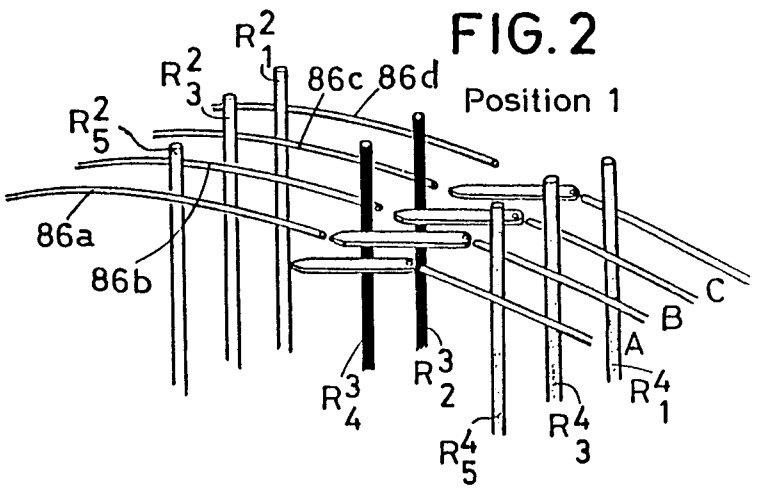
FIG. 1–4 illustrate the relative positions of the rods, the filaments and the needles in different stages of the operation for weaving a reinforcement element.
Figure 1:
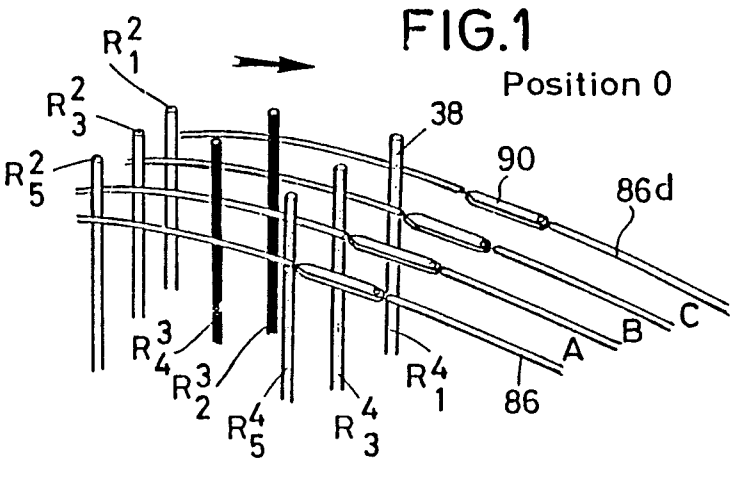
Figure 4:
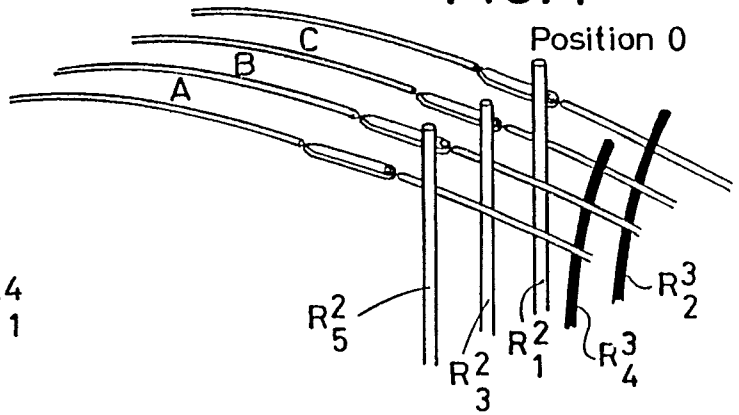
Figure 3:
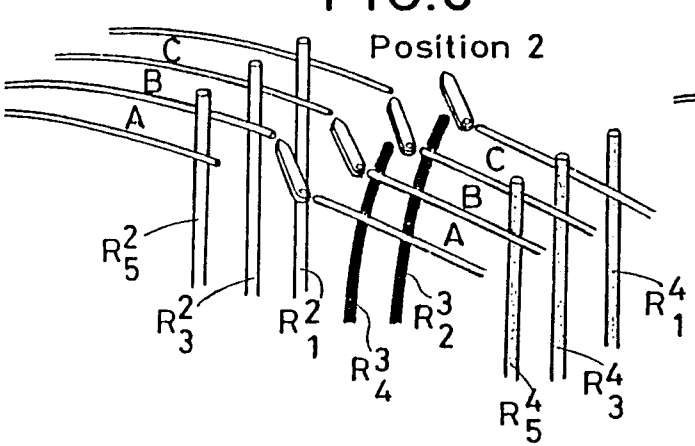

With reference to the drawings, and more particularly to FIG. 1–4 which illustrate the basic priniciple of the method in accordance with the invention, there are partially shown filaments **86*a*, 86*b*, 86*c* and 86*d***, which form respectively horizontal concentric loops having each a gap and defining therebetween circular passages A, B, C.

In the gap of each loop is provided a switching means comprising a movable needle which can be oriented from a 0 position (neutral) to a 1 position oriented toward the center or to a 2 position oriented toward the exterior.

Flexible vertical rods 38 are arranged in circular radially aligned rods, and are moved with their upper ends positioned in the circular passages A, B, C, whilst layers C1 to C6 of warp threads are laid beneath the filaments 86*a, b, c* and *d*, and the needles 90 are alternatively switched in the 0, 1 or 2 positions so as to deflect said upper ends of said rods 38 and cause them to move from one passage into another adjacent one in accordance with a predetermined sequence.

Referring to FIGS. 5–15, one uses to this aim a machine comprising a frame consisting of a base 1 carrying, in the illustrated embodiment, vertical guide columns between and on which are mounted horizontal slidable lower and upper frames, which are also vertically movable.

The frames carry inner rotary lower and upper rings 20 and 21, respectively.

The rotary ring 20 carries a disk 24 and an arrangement of electric vibrators.

The rotary ring 21 carries a disk 31 having apertures 32 aligned in radial and circumferential rows and a central support 33 on which are fixed radially extending strips 34 (FIG. 6) spaced from the disk 31 at a sufficient distance to permit the passage of a device for supplying replacement threads which is not part of the invention and adapted to replace the rods disposed in the orifices 32 by threads, in the known manner in three-dimension weaving machines of the prior art, such as disclosed in U.S. Pat. No. 4,393,669.

Figure 6:
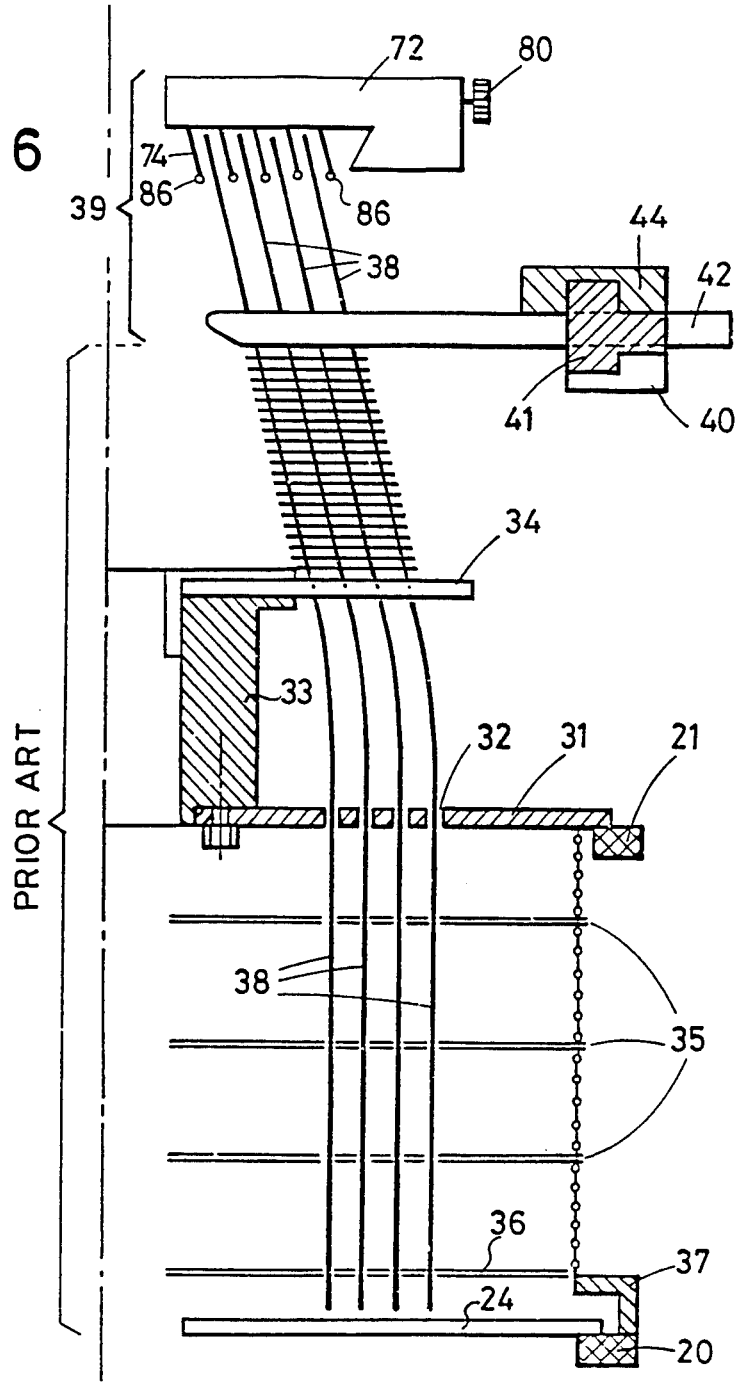
FIG. 6 is another diagrammatic view of the machine of FIG. 5.

Disposed between the rings 20 and 21 are a plurality of disks 35, 36 having rows of radially and circumferentially aligned orifices in a manner corresponding to orifices 32 of the disk 31, the disks 35 being suspended by chains and the disk 36 being fixed to the ring 30 by a support 37 (FIG. 6).

Flexible rods 38 are disposed in the aligned orifices of the stepped disks 32, 35 and 36 and their lower ends bear against the non-perforated disk 34 including the electric vibrator. These rods represent the woof threads.

The arrangement described hereinbefore is on the whole similar to that of the machine for weaving reinforcements in three dimensions disclosed in U.S. Pat. Nos. 4,183,232 and 4,346,741.

In order to bring up the method according to the invention, the machine comprises in its upper part a knitting apparatus fixed to the top of the columns 2 and generally designated by the reference character 9.

KNITTING APPARATUS

The knitting apparatus 39 comprises a frame 40 and carrying a rotary ring 41 including radial grooves (FIG. 7) in each of which is freely slidable a bar 42, these grooves having a depth which is double the height of the bars.

The bars 42 have a thickness which decreases toward their ends located adjacent to the center of the ring 41 (FIG. 9) and the grooves of the latter are such that the bars extend between the radial rows of rods 38.

At their outer ends, the bars 42 have a vertical notch 43 and they are maintained by an annular pressure plate 44 whose lower surface has a coating 45 composed of a material having a low coefficient of friction.

The plate 44 includes a plurality of radial grooves 46 in its upper surface and is fixed in position by radial support tabs 47 fixed to the frame 40; between two of these grooves, the presser plate 44 has a notch 48 in its outer periphery, in the region of which is mounted a device for recycling the bars 42 generally designated by the reference character 49 (FIG. 8) fixed by one end to the plate 44 and by its opposite end to the frame 40.

RECYCLING DEVICE

This device 49 for recycling the bars 42 comprises (FIG. 8) a support 50 radially fixed to the periphery of the frame 40 and carrying at its outer end a bracket 51 vertically and horizontally adjustable on the support 50 by two orthogonal slides (not shown) in the known manner.

Fixed on the bracket 51 is an end of a rod 52 on which a driving device 53 is slidable, the opposite end of the rod 52 being fixed to the plate 44 by a second bracket 54 similar to the bracket 51 and also vertically and horizontally adjustable.

A U-sectioned channel 55 is arranged to be parallel to the rod 52 with its opening facing toward the latter. Slidably disposed in this channel is a member 56 fixed to a tab 57 rigid with the driving device 53 so that the latter drives the member 56 along the channel when it travels along the rod 52.

The channel 55 is supported on the brackets 51, 54 by jacks 58 so as to be vertically movable under the action of the latter through a short distance equal to the height of a bar 42, the arrangement being such that the end of the member 56 in the channel 55 is located in facing relation to one of the bars 42 sliding in a groove of the ring 41.

Figure 5:
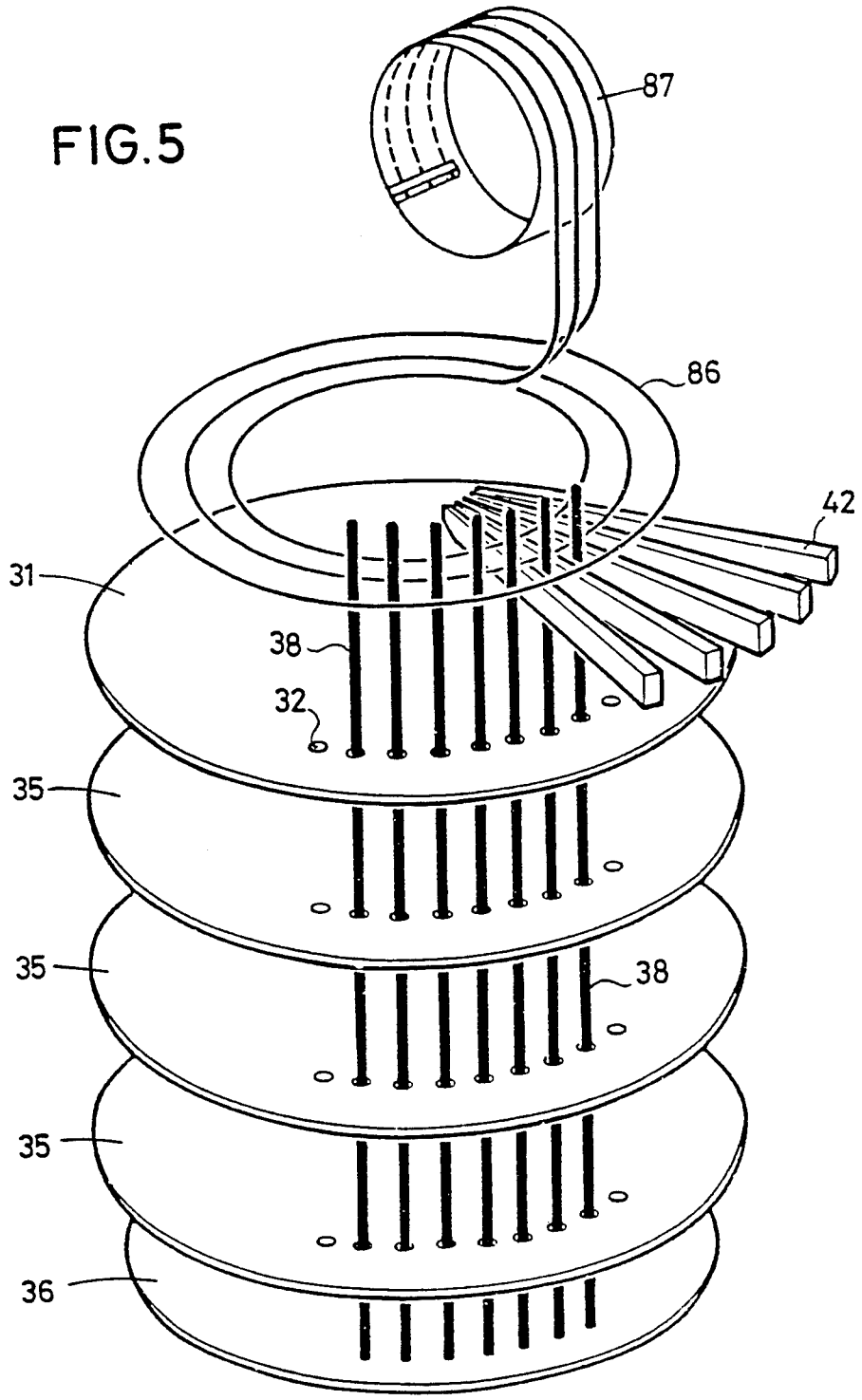
FIG. 5 is a diagram of the machine used to bring out the method of the invention.

The member 56 has an end extending toward the center of the ring 41 and this end is hook-shaped and complementary to the notch 43 of the bars so as to be capable of hooking into the latter (FIG. 5).

Figure 7:
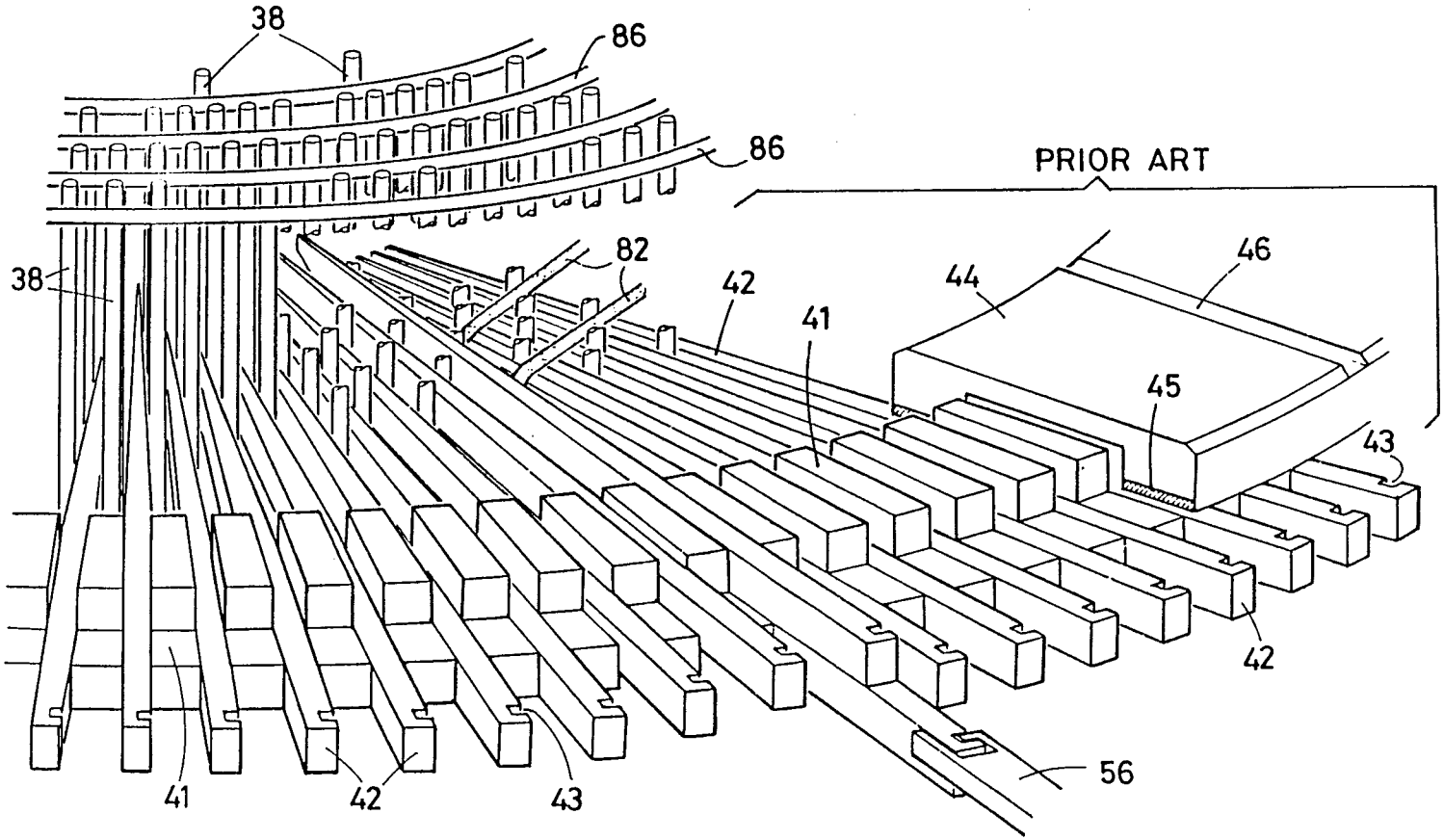
FIG. 7 is a partial view, to an enlarged scale, of the arrangement of the radially-grooved ring, of the strips sliding in the grooves and of the pressing plate, relative to the rods and filaments.
Figure 8:
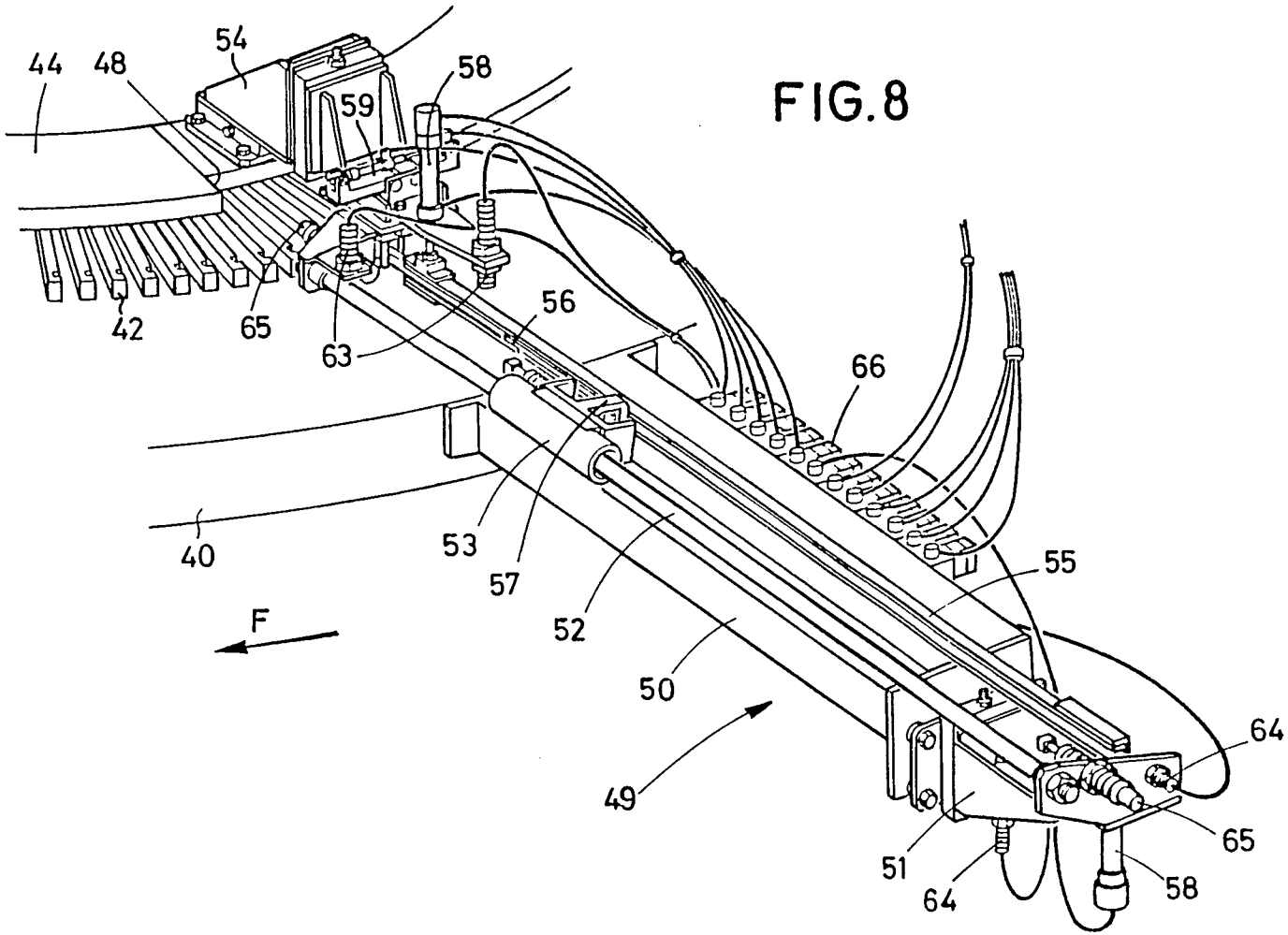
FIG. 8 is a partial view of the device for recycling the strips sliding in the grooved ring.
Figure 9:
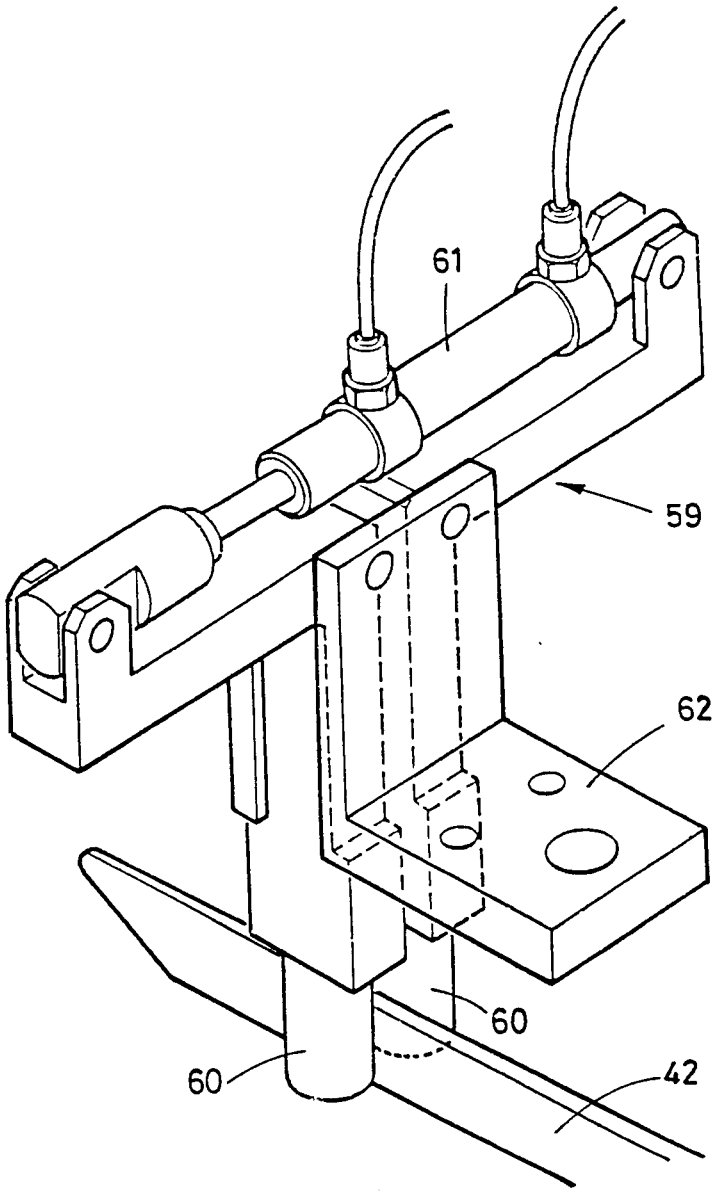
FIG. 9 is a view, to an enlarged scale, of the tongs for guiding the strips which are part of the device for recycling the strips.
Figure 10:
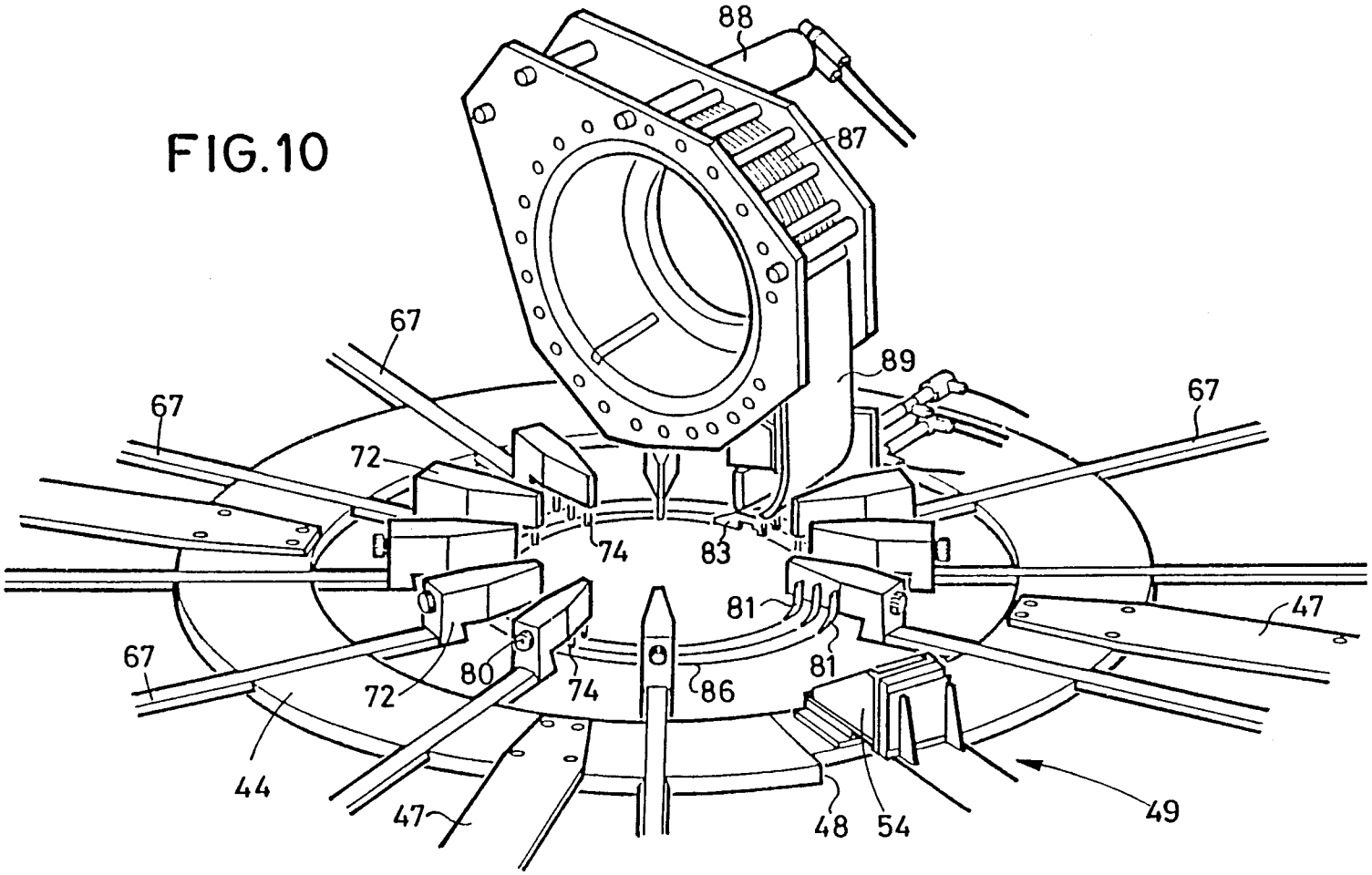
FIG. 10 is a partial view of the upper part of the machine, with the arrangement of the device for regulating the diameter of the reinforcement.
Figure 11:
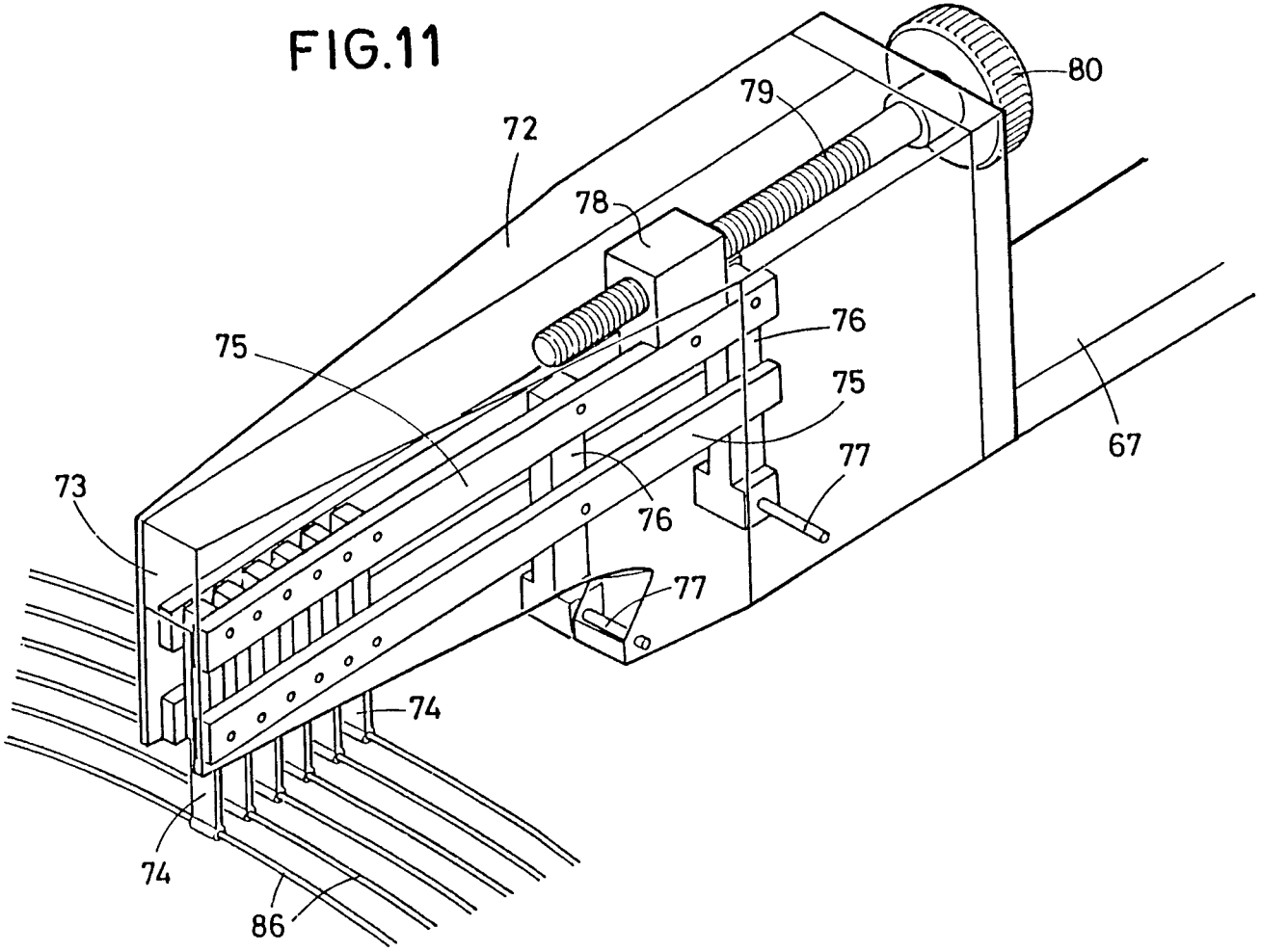
FIG. 11 is a partial view of one of the means for supporting the filaments and displacing the latter.
Figure 12:
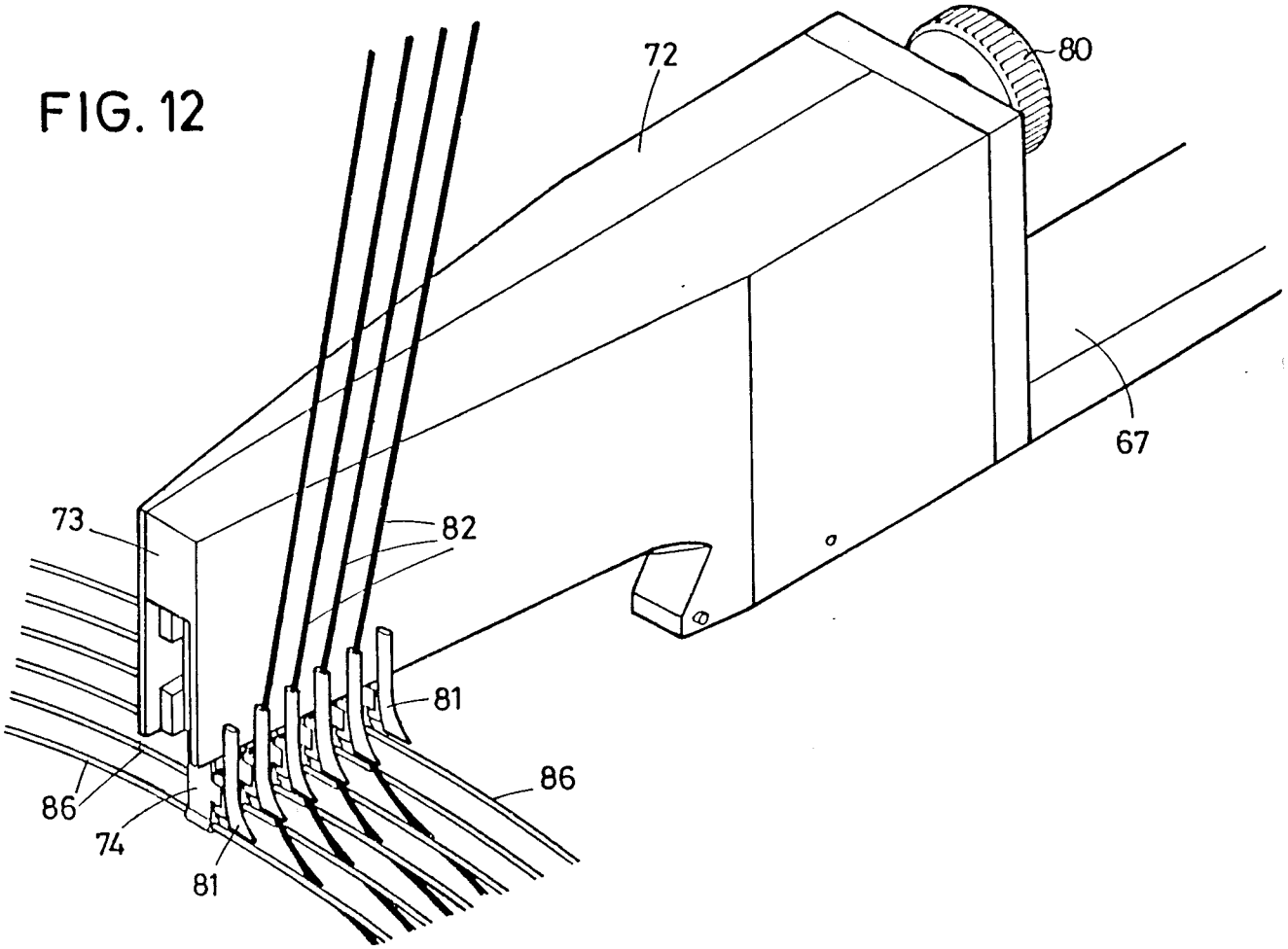
FIG. 12 is a view similar to FIG. 9 also showing the means for guiding the warp threads.
Figure 13:
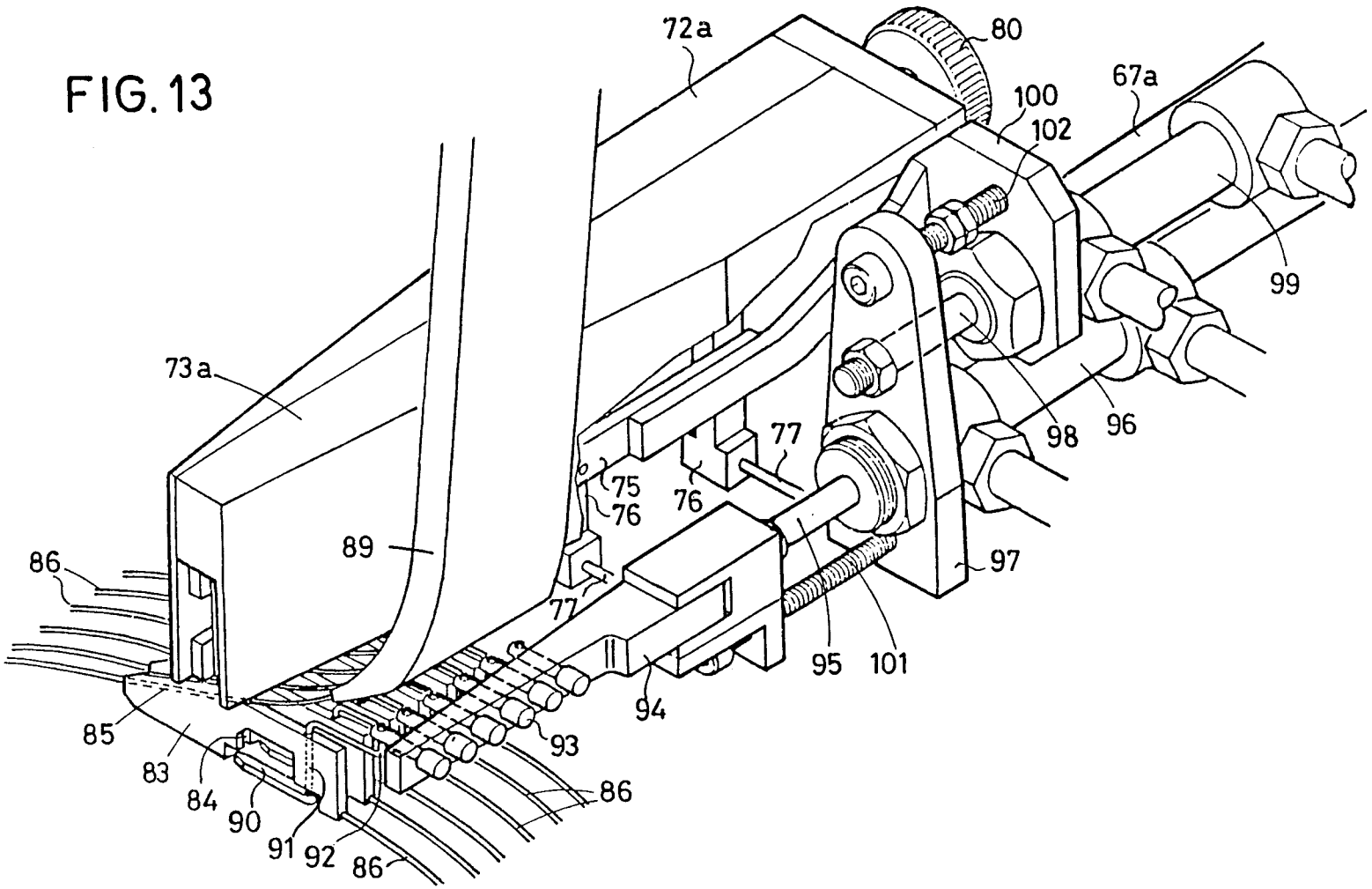
FIG. 13 is also a similar view of the head carrying the needle actuating system.
Figure 14:
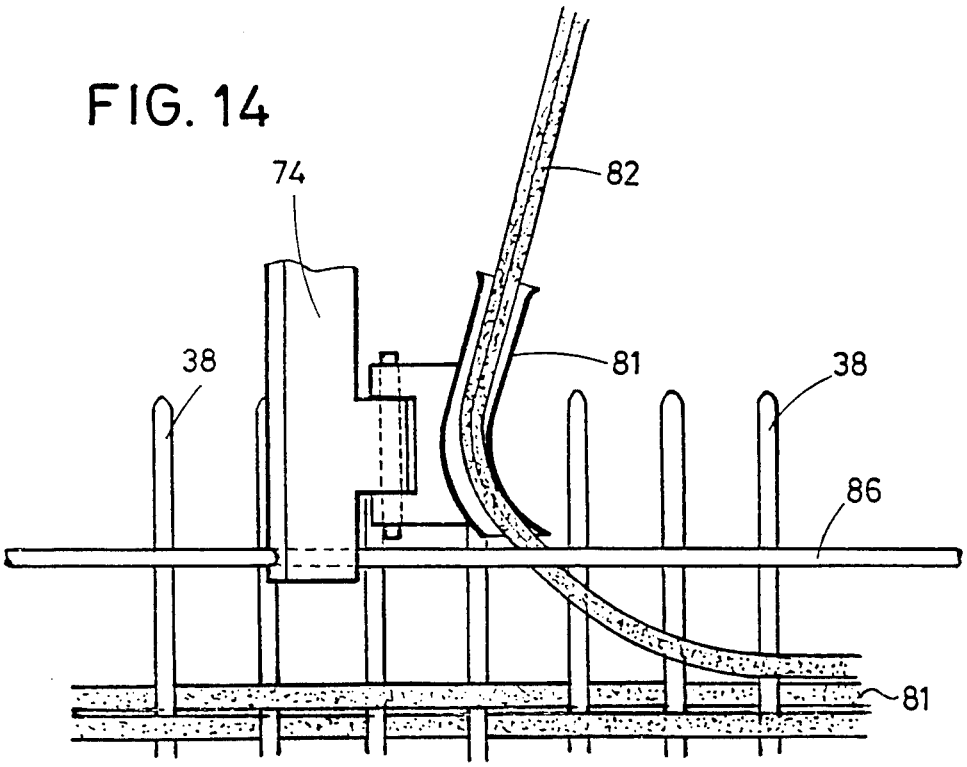
FIG. 14 shows the depositing of a warp thread between the rows of vertical rods.

The device 49 for recycling the bars is completed by a tongs 59 mounted on the bracket 54 and represented in FIG. 7.

This tongs 58 has two vertical branches each provided with a freely rotatable roller 60 at their lower end and so mounted as to be capable of moving toward or away from each other under the action of a low-power pneumatic jack 61. The tongs 59 is fixed to the bracket 54 by an L-shaped member 62 so that the gap between the rollers 60 is located in facing relation to the end of the member 56.

Provided on the brackets 51 and 54 are sensors 63 and 64 for the positions of the driving device 53 and the channel 55, respectively, and shock-absorbers 65 constituting stops for damping the rapid displacements of the device 53.

The pneumatic jacks 58, 61 and the sensors 63, 64 are connected to a connecting element 66 on the support 50 connected to an electronic control device (not shown).

DIAMETER-REGULATING DEVICE

The knitting apparatus also comprises means for guiding the rods and regulating the diameter of a part knitted on the machine shown in FIGS. 10 to 13.

These means comprise a plurality of radial arms 67 slidable mounted in the grooves 46 of the presser plate 44 and carried at their outer end by actuating devices 68 mounted on the periphery of the plate 40.

Each radial arm 67 has at its inner end a case 72 (FIGS. 11 and 12) having a hollow nose 73 in which are mounted vertical tabs 74 articulated to two horizontal parallel arms 75 which are articulated to two vertical links 76 pivotally mounted on fixed pins 77 and forming with these arms a parallelogram structure deformable by means of a nut 78 and a screw 79 provided with a knurled knob 80 outside and at the rear of the case 72 for incliding the tabs 74 at ±30° to the vertical without shifting their lower end.

In the illustrated embodiment, there are provided nine radial arms 67 such as those described hereinbefore spaced apart on the periphery of the frame 40, but this number may be different, depending on the size of the machine.

A tenth arm 67 differs from the preceding arms as concerns its tabs 74 each of which carries laterally a guide tube 81 through which passes a warp thread 82 (FIG. 10) coming from a supply reel (not shown) located above the machine. This tenth arm is located before the notch 48 of the plate 44, i.e., before the recylcing device 49, with reference to the direction of rotation of the assembly which occurs in the direction from the right to the left as indicated by arrow F of FIG. 6.

An eleventh radial arm **67*a* (FIG. 13) has at the end of its nose 73*a* a plurality of parallel elongated vertical plates 83 each having a notch 84 in its lower edge and arranged to be perpendicular to the axis of the arm 67*a*. The plates 83, as the tabs 74**, are inclinable by the same deformable parallelogram system.

Each plate 83 has within its thickness an oblique passage which is represented in dotted lines at 85, extends from one end of the plate and opens out at its upper edge roughly halfway along its length, and in which is slidable a flexible filament 86, for example constituted by a piano wire coming from a winding and unwinding drum 87 mounted above the radial arm **67*a* and driven by a motor 88; the filaments 86 being guided by a trough 89 toward the passageways 85 of the plates 83**.

The filaments 86 extend, after leaving the passageways 85 of the plates 83, in succesion through eyeholes of the tabs 74 of the various radial arms and returns at the opposite end of the plates 83 to which their end is fixed, for example by brazing.

It will be understood that, with this arrangement, the filaments 86 form open horizontal loops which are located above the radial bars 42 and may be made larger or smaller by a synchronized actuation of the motors 71 and 78, the drum 87 supplying or taking up the necessary lengths, as required.

It will be observed that the arrangement is such that the rods 38 extend between the filaments 86 and that the ends of these rods extend beyond the top of the filaments a sufficient distance to be guided therebetween when the rings 20, 21 and 41 and the plates 31, 35 and 36 rotate together. However, this height is a little less than the depth of the notches 84.

The open side of each notch 84 is closed by a needle 90 articulated by its end adjacent to the brazed end of the filament 86 on a vertical pin 91 which is rotatable in a passage provided within the thickness of the plate 83 and formed by a branch of a crank whose crank pin 92 is engaged in a transverse aperture in a pin 93 which is freely rotably mounted in a movable member 94 extending in a direction parallel to the arm **67*a***.

The movable member 94 is fixed to the rod 95 of a first jack whose cylinder 96 is fixed to a member 97 fixed to the rod 98 of a second jack whose cylinder 99 is fixed to a support 100 mounted on the lower arm 75 of the deformable parallelogram structure in the case **72*a*. With this arrangement, the position of the needle 90 is not modified by the inclination of the plates 83**.

Screws 101 and 102 constitute adjustable stops on the member 97 and the support 100, respectively, and enable the travels of the jacks 96 and 99 to be adjusted, these jacks being pneumatic jacks controlled by the aforementioned electronic device.

OPERATION

First of all, the rods 38 are placed in position bearing against the disk 24 and extending through the orifices of the various disks and between the bars 42 and the filaments 86, and the end of each warp thread 82 is fixed on the disk 31 so that the rotation of the latter drives the warp threads.

Before starting a work cycle of the machine, the diameter of the loops formed by the filaments 86 is adjusted.

The rings 20, 21 are driven in rotation and all of the intermediate disks with the rods 38, and the warp threads 82 are disposed by the guide tubes 81 between the rows of bars 38.

Simultaneously, a groove of the ring 41 containing a bar 42 is presented in front of the channel 55 which contains an additional bar 42 hooked to the end of the member 56 and is in the upper position, the driving device 53 being shifted back outwardly and the end of the bar 42 being gripped between the rollers 60 of the tongs 59. The rotation of the rings 20, 21 is stopped.

The device 53 drives the member 56 which urges the bar 42 contained in the channel 55 toward the center of the machine and the rollers of the tongs move apart and this bar 42 comes to be disposed in the groove of the ring 41 on top of the bar 42 which is already in this groove above the layer of warp threads owing to the convergent shape of its end.

The jacks 68 then lower the channel 55 and the end of the member 56 is hooked onto the bar 42 at the bottom of the groove.

As the branches of the tongs are open, the device 53 moves back along the rod 52 and drives this bar 42 in the channel, which the jacks 58 then raise to the upper position and the tongs again grips the end of the bar.

This cycle is repeated each time a groove of the ring 41 reaches a position in front of the channel.

While this sequence of the recycling of the bars 42 occurs, the rods 38 advance in the passages A, B, C . . . defined by the filaments 86 which guide them, and the ring 21 is lowered up to a distance corresponding to the thickness of the deposited layer of warp threads 82.

While the rods 39 travel along the passages between the filaments 86, the thread guides 81 deposit the warp theads 82 under the filaments between the circular rows of rods 38 on the bars 42 which are placed back on top of the threads 82, one after the other by the bar-recycling device 49 between the radial rows of the bars.

Figure 15:
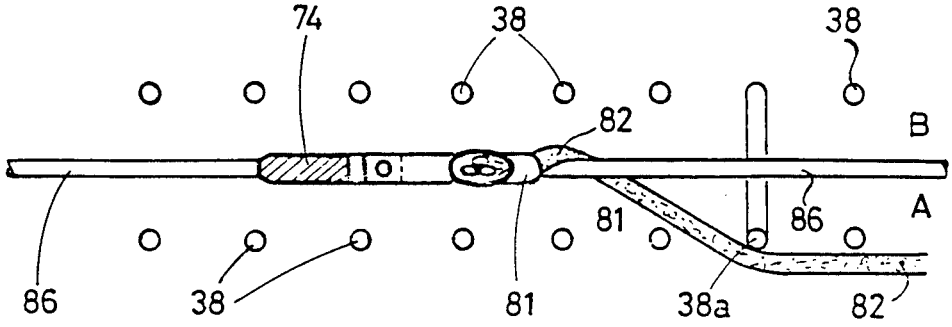
FIG. 15 is a similar top plan view of the rods and a warp thread.

In the course of the rotation of the assembly, the needles 90 are shifted by the jacks 96 and 99 by pivoting about the pins 91 so as to pass the flexible rods 38 of the radial rows from one passage to the other in the manner of a switching by bending them in accordance with a predetermined sequence stored in the memory of the electronic device so as to constrain the warp threads 82 to place themselves in another passage during a part of the rotation of the assembly as diagrammatically shown in FIG. 15 which shows a rod 38a which has been deviated to pass from the passage B into the passage A by a needle 90.

Figure 16:
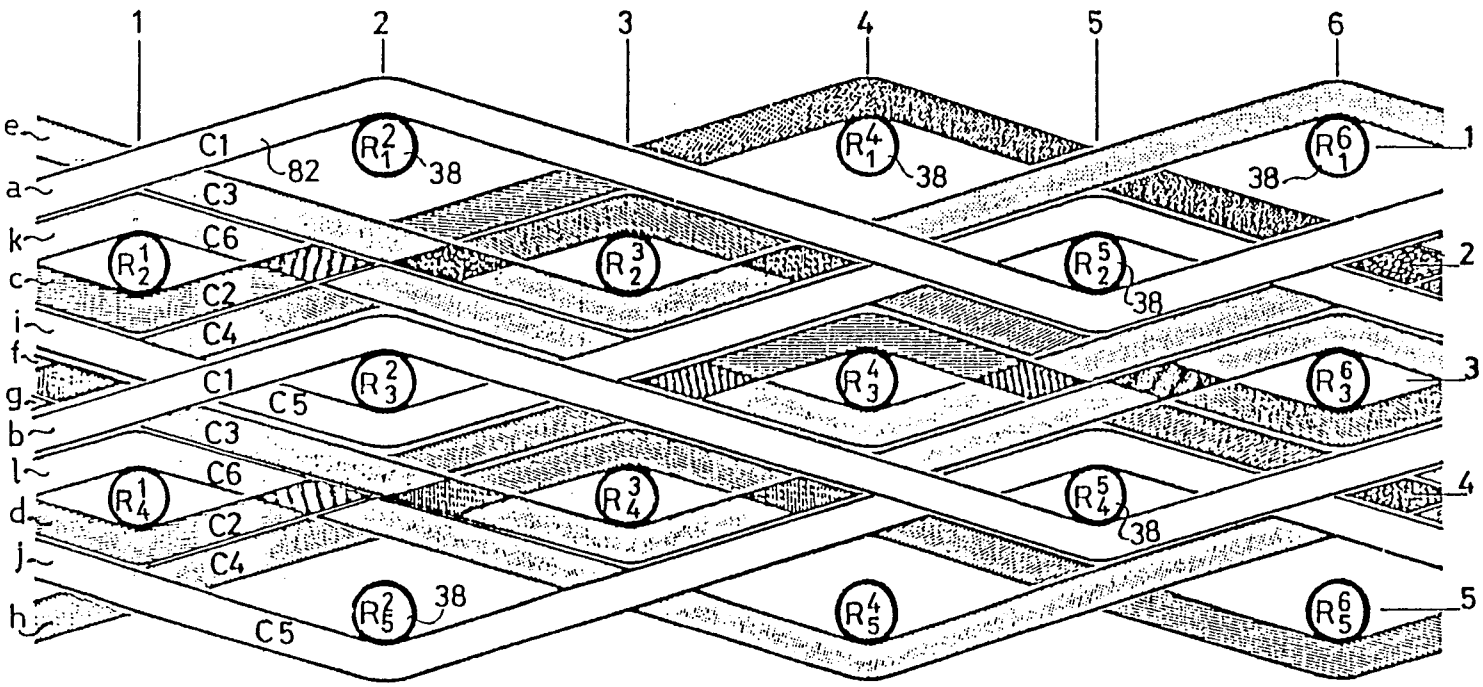
FIG. 16 is a view to a large scale of the texture of the basic pattern of the reinforcement woven by means of the method according to the invention.

The sequence of the switching and bending of the upper parts of the rods 38 is predetermined in order to obtain the arrangement of the warp threads a, b, c, . . . 1 producing the texture represented in FIG. 16 in which the woof threads $R_5^2$, $R_3^2$, $R_1^2$ of the column 2, $R_4^3$, $R_2^3$ of the column 3 and $R_5^4$, $R_3^5$, $R_1^4$ of the column 4 correspond to the rods 38 (FIGS. 1 to 4).

If N designates the number of rods 38 in a circumferential passage A, B or C, and if the positions of the needles 90 are designated by 0 when they are aligned with the filaments to which they correspond, by 1 when they are positioned toward the center of the machine, by 2 when they are positioned toward the exterior, the sequence of the displacements of the needles for producing the arrangement of the various layers C1 to C6 forming the reinforcement shown in FIG. 16, will be the following during six complete revolutions of the assembly, namely for the basic pattern:

For the layer C1 : 1, 1, 0, 0, 0, 1×N/6
For the layer C2 : 0, 2, 2, 0, 1, 1×N/6
For the layer C3 : 2, 0, 1, 1, 0, 2×N/6
For the layer C4 : 0, 2, 2, 2, 0, 0×N/6
For the layer C5 : 1, 1, 0, 2, 2, 0×N/6
For the layer C6 : 2, 0, 1, 1, 0, 2×N/6.

After any rod 38 has been switched into another circular passage, this rod remains in this passage during a complete rotation of the assembly.

When the weaving of the reinforcement has started and a plurality of layers of warp threads has been deposited, the jamming of the threads 82 relative to the rods 38 is then such that is is then possible to slightly lower the lower frame by actuating the device 19 so as to move the disk 24 slightly away from the lower ends of the rods 38. This disk is then prevented from rotating and the vibrator is actuated and maintained in operation throughout the duration of the weaving of the reinforcement.

The ring 21 is then lowered for bringing the lower ends of the rods 38 into contact with the disk 24, then, after each complete rotation of the assembly, the ring 21 is lowered a distance less than the amplitude of the vibrations generated by the vibrator means.

When the rods 38 of a radial row are vibrated by means of said vibrator, the vibrations causes them to rise and slide between the already-deposited warp threads without entraining along therewith the layers of the threads which are held stationary by friction on the other rods 38 not driven by the said vibrator means.

In the reinforcement to be produced has a non-constant diameter, the diameter of the loops formed by the filaments is adjusted at the required moments, as well as the angle of the tabs 74 and plates 83 by actuating the knobs 80, and the height of the lower ring.

When the height of the reinforcement is reached, the machine is stopped and each rod 38 is replaced by the appropriate length of woof thread by means of a lacing apparatus of known type such as that, for example, disclosed in U.S. Pat. No. 4,393,669.

In the described embodiment, the plate 40 carrying the knitting apparatus is fixed to the upper part of the machine. In a modification (not shown), this plate may also be movable in height.

It will be understood that the electronic device may be a computer of any known type suitable programmed for controlling the various elements of the machine in accordance with the required sequence.

What is claimed is:

1. A method for knitting composite reinforcements with woof threads and warp threads having a texture formed by a basic pattern constituted by fifteen woof threads R arranged in staggered relation forming six columns 1 to 6 of alternately two and three threads and at least five lines 1 to 5 perpendicular to said columns and each having three threads, and by six imbricated layers C1 to C6 of at least two parallel warp threads, namely at least twelve threads a, b, c . . . 1 each connecting every third woof thread of the same column in two adjacent lines and the warp threads of the consecutive layers connecting woof threads in alternated columns, the first thread a of the first layer C1 connecting the woof thread R of the column 2 in line 1, namely $R_1^2$ to the woof thread R of column 5 in line 2, namely $R_2^5$; the second thread b of the first layer C1 connecting the woof thread R of column 2 in line 3, namely $R_3^2$, to the woof thread R of column 5 in line 4, namely $R_4^5$; the first thread c of the second layer C2 connecting the woof thread R of column 1 in line 2, namely $R_2^1$, to the woof thread R of column 4 in line 1, namely $Rx_1^4$; the second thread d of the second layer C2 likewise connecting the woof threads $R_4^1$ and $R_3^4$, the paths of the threads of the following layers C3 . . . C6 being obtained by adding 2 to each preceding corresponding column reference, namely, for the first thread of layer $C3 = R_2^{1+2} = R_2^3$ and $R_1^{4+2} = R_1^6$, etc., this pattern being capable of being enlarged in the direction of the thickness of the material to be produced with an uneven number of lines, said method comprising rotating flexible and elastic rods disposed in circular rows of radially aligned N rods representing the woof threads R so that their upper ends circulate in concentric circular passages formed by filaments each including radially aligned switching means, depositing the layers of warp threads C1 to C6 under and in alignment with the filaments, elastically bending and deviating said ends of the rods by the action of said switching means by shifting said switching means between a neutral position 0, a position 1 oriented inwardly and a position 2 oriented outwardly in accordance with the following sequence during six complete rotations, namely for the basic pattern:

For the layer C1 : 1, 1, 0, 0, 0, 1×N/6
For the layer C2 : 0, 2, 2, 0, 1, 1×N/6
For the layer C3 : 2, 0, 1, 1, 0, 2×N/6
For the layer C4 : 0, 2, 2, 2, 0, 0×N/6
For the layer C5 : 1, 1, 0, 2, 2, 0×N/6
For the layer C6 : 2, 0, 1, 1, 0, 2×N/6 and replacing said rods by the woof threads R proper.

* * * * *